US008424638B1

(12) United States Patent
Guthrie et al.

(10) Patent No.: US 8,424,638 B1
(45) Date of Patent: Apr. 23, 2013

(54) SWIVEL ANCHOR POINT FOR FALL PROTECTION

(76) Inventors: Karl Guthrie, Austin, TX (US); Joseph Schwartz, Wimberley, TX (US)

( * ) Notice: Subject to any disclaimer, the term of this patent is extended or adjusted under 35 U.S.C. 154(b) by 0 days.

(21) Appl. No.: 12/798,272

(22) Filed: Apr. 1, 2010

(51) Int. Cl.
*A62B 35/00* (2006.01)

(52) U.S. Cl.
USPC ..... 182/3; 248/499

(58) Field of Classification Search ..... 248/499; 182/3
See application file for complete search history.

(56) References Cited

U.S. PATENT DOCUMENTS

| | | | | |
|---|---|---|---|---|
| 5,004,071 | A * | 4/1991 | Mallard et al. | 182/3 |
| 5,248,176 | A * | 9/1993 | Fredriksson | 294/215 |
| 5,405,210 | A * | 4/1995 | Tsui | 403/119 |
| 6,293,600 | B1 * | 9/2001 | Lecourt | 294/215 |
| 7,036,858 | B2 * | 5/2006 | Buck | 294/215 |
| 2002/0014569 | A1 * | 2/2002 | Pearl | 248/499 |
| 2002/0185873 | A1 * | 12/2002 | Alba | 294/1.1 |

OTHER PUBLICATIONS

DB Industries, Inc., DBI Sala User Instruction Manual Concrete Bolt Anchorage Connector, p. 1, copyright 2004.

DB Industries, Inc., DBI Sala User Instruction Manual D-Ring Anchorage Connector, copyright 2008.

Carr Lane Manufacturing Company, Swivel Hoist Rings, from the website (copied Nov. 10, 2009): http://www.carrlane.com/Catalog/index.cfm/26825071F0B221118070C1C512D020609090C0015482013180B041D1E173C3B28535540.

Urban H.A.R.T, UH-MSAN005: MSA D-Plate Anchorage Connector, p. 3, from website (copies Jan. 27, 2010) http://w.w.w..urbanhart.com/shopsite/hardware_beamanchors.html.

* cited by examiner

*Primary Examiner* — Alvin Chin Shue
(74) *Attorney, Agent, or Firm* — Portland Intellectual Property, LLC

(57) ABSTRACT

A swivel anchor point for fall protection. The swivel anchor point includes a ring element and a housing element. The ring element defines a closed attachment aperture. The housing element is adapted to receive and retain the ring element such that the ring element can be freely rotated through a swivel angle of at least 180 degrees about a swivel axis, and freely rotated through a pivot angle of at least 90 degrees about a pivot axis that is perpendicular to the swivel axis and that substantially intersects the swivel axis. The ring element includes two spaced apart leg members, the leg members having foot portions extending inwardly, toward the swivel axis. The foot portions have respective, spaced apart relatively enlarged ends. The housing element includes apertures corresponding to these ends, the apertures being suitably sized, closer to the swivel axis, for pivotally receiving the ends, while being of a sufficiently smaller size, farther from the swivel axis, to prevent passage of the ends therethrough.

12 Claims, 4 Drawing Sheets

SWIVEL ANCHOR POINT FOR FALL PROTECTION

FIELD OF THE INVENTION

The present invention relates to anchor points, for attaching a lanyard, strap or cable, to provide fall protection for a worker.

BACKGROUND

In construction, there is a need to tether construction workers to the structure being constructed, so that if the worker falls, the fall is short rather than deadly. What are known as "anchor points" have been provided in the prior art to help serve this purpose. Anchor points attach to the structure, e.g., the floor, wall, roof, or other structural element, and typically have a ring or through-hole to which a lanyard, strap or cable can be attached. That part of the anchor point that mounts to the structure can vary considerably; however, anchor points having rings generally share the characteristic that the ring is either fixedly disposed, or if it pivots, it does so such that the plane of the ring sweeps through a range of angles (e.g., 0-180 degrees) relative to the plane defining the surface to which the anchor point is mounted.

FIG. 1 illustrates the described pivoting. An anchor point 2 comprises a ring 4 and a strap 5 which mounts the ring to a structure 8 defining a mounting surface 6. A Cartesian coordinate system is also shown for reference. The x and y axes of the coordinate system are aligned with the mounting surface 6. The ring defines a plane "P" that pivots about a line "A" which is aligned with the x-axis. A line "B" is chosen that both lies in the plane P and is perpendicular to the line A, and the ring can pivot such that the angle δ defined between the line B and the mounting surface 6 varies between 0 and 180 degrees. Such anchor points will be referred to herein as pivot anchor points.

The pivot anchor point allows for pivoting that tracks a worker's movements in a plane aligned with the y and z axes. However, the present inventor has recognized that there is a need for an anchor point that provides for pivoting about the z axis, to track the worker's movements in a plane aligned with the x and y axes.

SUMMARY

A swivel anchor point for fall protection is disclosed herein. The swivel anchor point includes a ring element and a housing element. The ring element defines a closed attachment aperture, for connecting thereto a caribiner or the like. The housing element is adapted to receive and retain the ring element such that the ring element can be freely rotated through a swivel angle of at least 180 degrees about a swivel axis, and freely rotated through a pivot angle of at least 90 degrees about a pivot axis that is perpendicular to the swivel axis and that substantially intersects the swivel axis. The ring element further includes two spaced apart leg members, the leg members having foot portions extending inwardly, toward the swivel axis. The foot portions in turn have respective, spaced apart relatively enlarged ends. The housing element further includes apertures corresponding to these ends, the apertures being suitably sized, closer to the swivel axis, for pivotally receiving the ends, while being of a sufficiently smaller size, farther from the swivel axis, to prevent passage of the ends therethrough. The apertures are thereby adapted to capture the ends within the housing element for securing the ring element.

Preferably, the swivel anchor point further includes a cap and baseplate, for capturing the housing element therebetween. The cap and baseplate are separable elements.

More preferably, the cap and baseplate include corresponding portions that abut one another so as to space the cap and baseplate apart by an amount greater than that required to clamp the housing element and prevent rotation thereof about the swivel axis.

Still more preferably, one of the portions of the cap and baseplate is adapted to be captured by the other so that the portions resist displacing one of the cap and baseplate relative to the other in response to forces applied perpendicular to said swivel axis.

Yet more preferably, one of the portions is adapted to be seated in the other.

It is to be understood that this summary is provided as a means of generally determining what follows in the drawings and detailed description and is not intended to limit the scope of the invention. Objects, features and advantages of the invention will be readily understood upon consideration of the following detailed description taken in conjunction with the accompanying drawings.

DETAILED DESCRIPTION OF PREFERRED EMBODIMENTS

Figure 1:
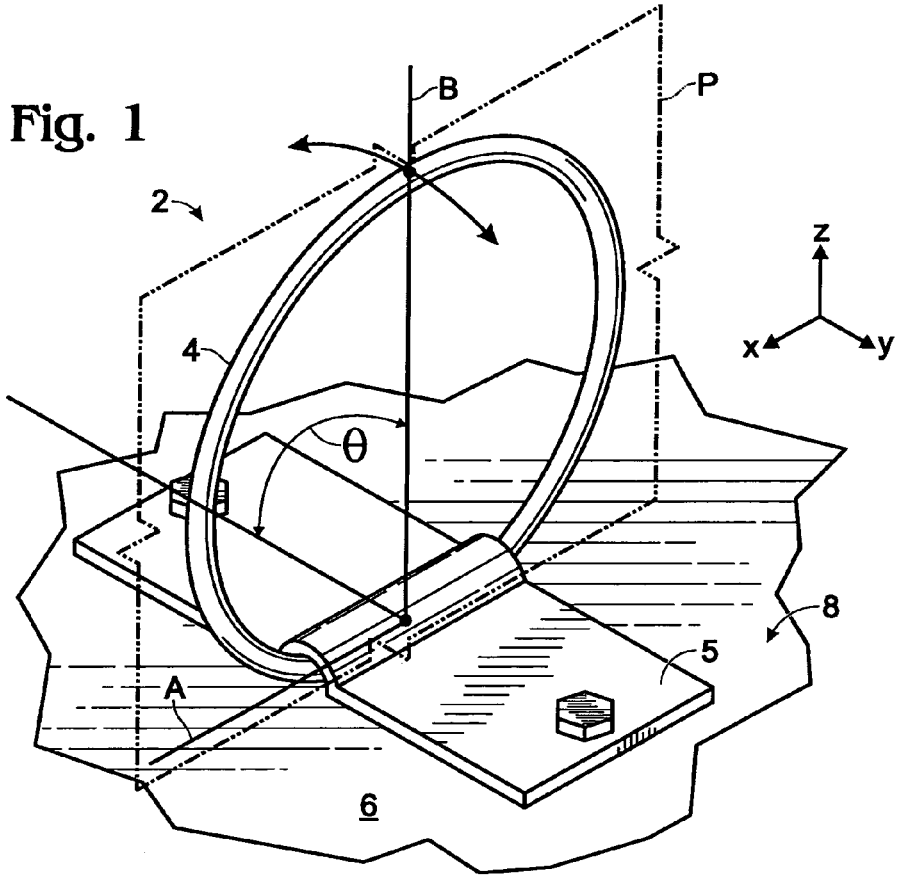
FIG. 1 is an isometric view of a prior art anchor point, illustrating a pivoting capability.
Figure 2:
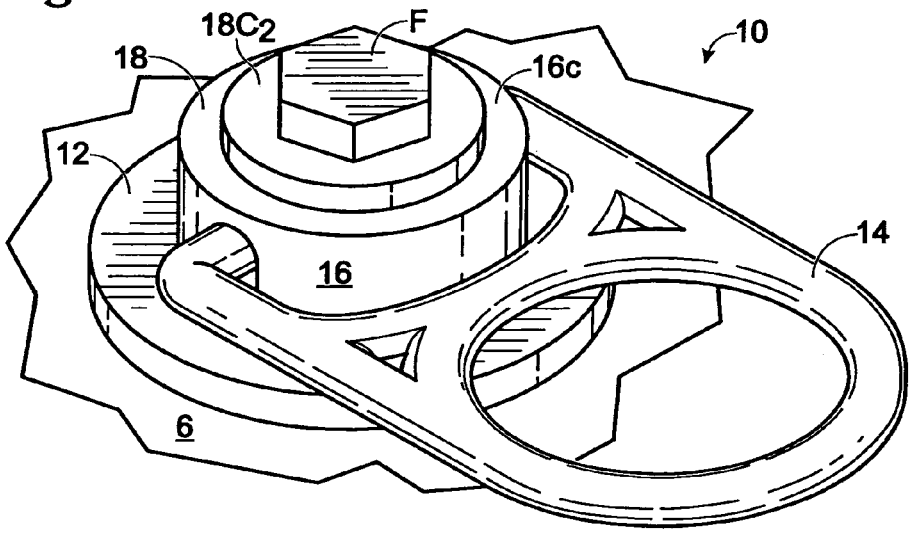
FIG. 2 is an isometric view of a swivel anchor point according to the present invention.
Figure 3:
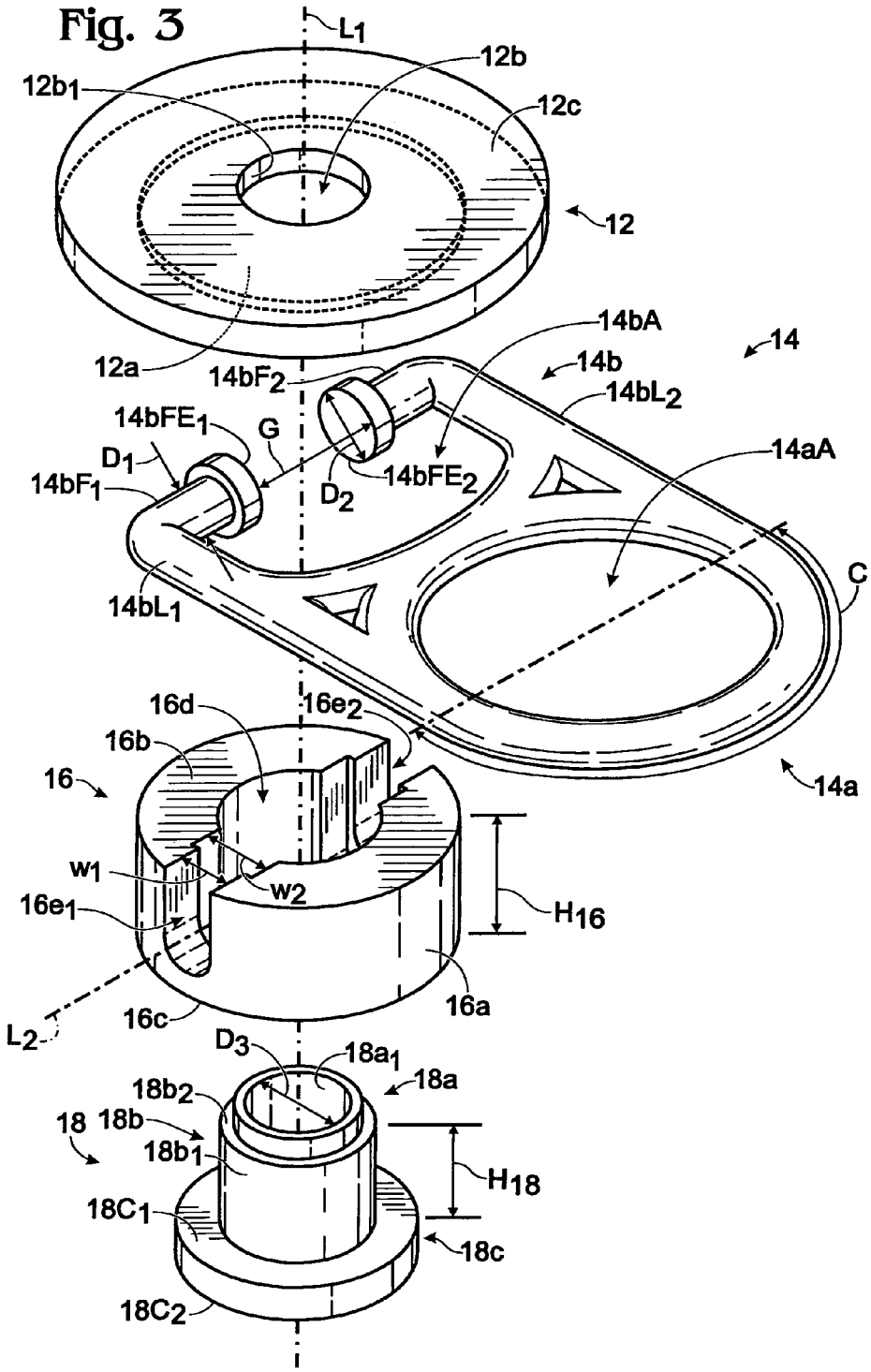
FIG. 3 is an exploded isometric view of the swivel anchor point of FIG. 2.
Figure 4:
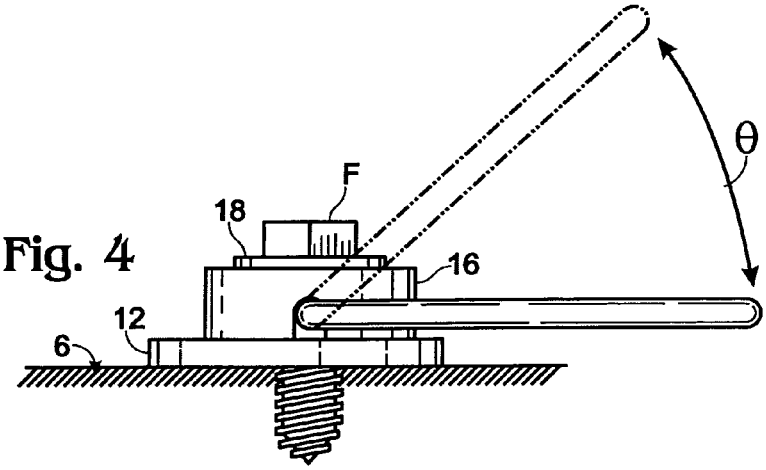
FIG. 4 is an elevation view of the anchor point of FIG. 2 mounted to a structure, illustrating a pivoting capability.
Figure 5:
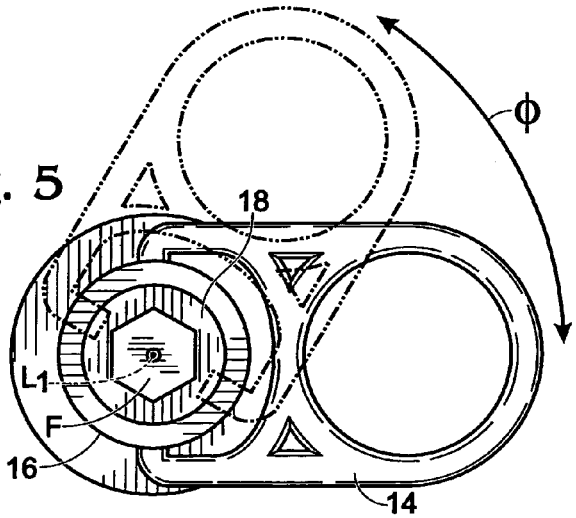
FIG. 5 is a top plan view of the anchor point of Figure, illustrating a swivelling capability.

FIG. 2 shows a preferred swivel anchor point 10 according to the invention, and FIG. 3 shows the anchor point 10 exploded. The anchor point provides for the same pivoting provided by the pivot anchor point described above in connection with FIG. 1, as indicated in FIG. 4, but also provides for swiveling azimuthally, about a central or swivel axis "$L_I$" corresponding to the aforementioned z axis, as indicated in FIG. 5 (angle ϕ). In these respects, it may be noted that the anchor point 10 provides the same freedom of movement that has been provided in prior art "hoist rings." However, the anchor point 10 provides at least three important structural points of departure, in addition to having a different use.

Referring particularly to FIG. 3, the anchor point 10 includes a "base plate" 12, a "ring" 14, a "swivel house" 16, and a "cap" 18. The parts are shown exploded along the axis $L_I$.

The ring 14 has a ring portion 14*a* defining an attachment aperture 14*a*A, for receiving a caribiner or the like, and a swivel house clearance portion 14*b* defining a clearance aperture 14*b*A. As shown, the overall shape of the ring 14 resembles a "D" and so it may be referred to as a "D ring."

The ring portion 14*a* of the ring 14 is "closed," meaning that over the entire 360 degrees of its circumference there are no gaps, the purpose being to prevent the caribiner or other attachment hardware from finding a passage through the ring portion so as to become unintentionally removed therefrom. The ring portion is also preferably annular over at least the radially outermost 180 degrees of its circumference ("C") so that the caribiner slides equally well over this range which, because the anchor point 10 can swivel as well as pivot, is sufficient to allow the user to move anywhere within a given radius of the anchor point 10.

By contrast to the ring portion 14*a*, the clearance portion 14*b* is "open," meaning that there is a gap in the aperture, here referenced as "G."

The swivel house clearance portion 14*b* of the ring 14 has two spaced apart, parallel legs 14*b*L, namely 14*b*L, and 14*b*$L_2$, each leg having a corresponding inwardly turned foot portion 14*b*F, namely 14*b*F, and 14*b*$F_2$. The foot portions 14*b*F have enlarged, flanged ends 14*b*FE, namely, 14*b*FE, and 14*b*$FE_2$. The flanged ends 14*b*FE are spaced apart to create the gap G.

The foot portions 14*b*F are cylindrical with diameters $D_1$, and the flanged ends 14*b*FE are cylindrical with enlarged diameters "$D_2$."

Reference is next made to the swivel house 16, which has a cylindrical exterior face 16*a*, a plane circular base plate-facing side 16*b*, and an opposed, plane circular cap-facing side 16*c* (not visible in FIG. 3, but indicated in FIG. 2). A circular central aperture 16*d* extends through the sides 16*b* and 16*c* centered on the axis $L_I$, and a pair of stepped apertures 16*e*, comprising apertures 16*e*, and 16*e*$_2$, extend through the side 16*a* along a perpendicular axis $L_2$ that intersects the axis $L_I$. The apertures 16*e* are open to the base plate-facing side 16*b*, but preferably do not extend to the cap-facing side 16*c*.

The apertures 16*e* have a width $w_1$ at the face 16*a*, and the width is increased, preferably step-wise, to $w_2$ nearer the central aperture 16*d*.

The dimension $w_1$ is selected to receive the foot portions 14*b*F, i.e., the diameter $D_1$, and the dimension $w_2$ is selected to receive the flanged ends 14*b*FE of the foot portions, i.e., the diameter $D_2$.

The base plate-facing side 16*b* of the swivel house 16 is essentially "capped" by abutting the side 16*b* to the base plate 12, particularly to a circular recessed portion 12*a* described below, which thereby confines the flanged ends 14*b*FE in a cavity defined between the increased width portions of the apertures 16*e* of the swivel house and the base plate 12. The narrower width of the radially outermost portions of the apertures 16*e* provides the important advantage of retaining the flanged ends in the cavity against laterally outwardly directed forces, particularly tensile forces applied to the D ring 14 such as by, e.g., an attached lanyard, in directions perpendicular to the axis $L_I$.

The cavity defined by the apertures 16*e* and the base plate 12 is suitably large, relative to the feet 14*b*F and flanged ends 14*b*FE, to allow for substantially free, pivoting rotation about the axis $L_2$.

Reference is next made to the base plate 12, which as mentioned above includes a circular, recessed surface 12*a* for receiving the side 16*a* of the swivel house. The recessed surface 12*a* provides the advantage of seating the swivel house and retaining it against laterally directed forces.

The base plate 12 further includes a circular through-hole 12*b* centered on the axis $L_I$, and has a cylindrical inside surface 12*b*$_1$.

The base plate still further includes a planar mounting surface 12*c*. This surface is adapted to mount to the structural member to which the anchor point is attached; particularly in this embodiment the planar surface portion 6 as described above in connection with FIG. 1.

Reference is next made to the cap 18, which has three cylindrical, stepped diameter portions, a base plate-facing portion 18*a*, a middle portion 18*b*, and a swivel house-facing portion 18*c*. The base plate-facing portion 18*a* has an interior surface 18*a*, which defines a through-hole centered on the axis $L_1$ that extends through the anchor point 10 for receiving a fastener "F" (see FIGS. 2 and 4), as well as an outer cylindrical surface of diameter $D_3$ sized to fit snugly into the through hole 12*b* of the base plate; the middle portion 18*b* has a cylindrical exterior surface 18*b*, having a diameter that is sized to be slidably received within the hole 16*c* through the swivel house, as well as a supporting surface 18*b*$_2$; and the outermost portion 18*c* has a capping surface 18*c*$_1$, that abuts the cap-facing surface 16*b* of the swivel house, to secure the cap to the swivel house when the cap is inserted through the hole 16*c* thereof, as well as a mounting surface 18*c*$_2$ (see also FIG. 2).

The through-hole defined by the base plate-facing portion 18*a* as described above is preferably over-sized relative to the fastener F, providing the advantage that the fastener F may be easily removed and replaced with a fastener of a different type or even size, so that the anchor point 10 can be mounted to various sizes, forms, and configurations of structural members.

The fastener is preferably tightened down on the anchor point 10, the tightening force being resisted by the base plate 12 and cap 18, leaving the swivel house stress free for free rotation about the axis $L_1$, carrying the ring 14 (and axis $L_2$) with it. On the other hand, the cap 18 and the base plate 12 are stationary as a result of frictional forces developed between these parts, the structure, and the head of the fastener, as a result of tightening the fastener. More specifically, the head of the fastener frictionally engages the mounting surface 18*c*$_2$ of the cap; the supporting surface 18*b*$_2$ of the cap frictionally engages the recessed surface 12*a* of the base plate, and the outer cylindrical surface of the base plate-facing portion 18*a* of the cap frictionally engages the inside cylindrical surface 12*b*, of the through hole of the base plate; and the mounting surface 12*c* of the base plate frictionally engages the surface 6 of the structure.

To ensure that the cap bears the tightening force rather than the swivel house, the height "$H_{18}$" (FIG. 3) of the middle portion 18*b* of the cap is provided to be sufficiently greater than the height "$H_{16}$" of the swivel house to allow for a slight clearance remaining between these parts when the cap compresses in response to the tightening force. Accordingly, the capping surface 18*c*$_1$ of the cap is spaced away from the cap-facing side 16*c* of the swivel house 16 so that there is substantially no frictional engagement between these surfaces.

Figure 6:
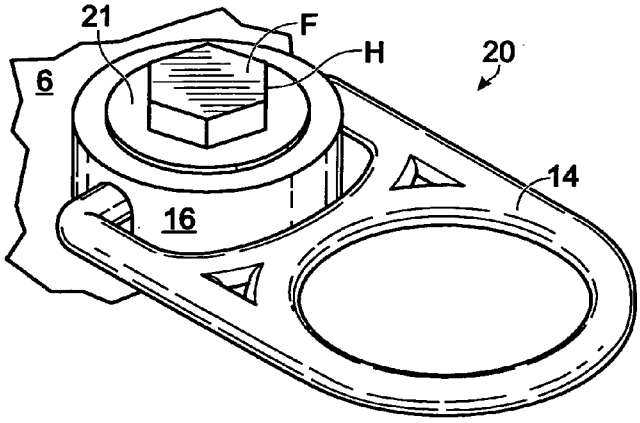
FIG. 6 is an isometric view of a first alternative embodiment of a swivel anchor point according to the invention.

As one alternative, FIG. 6 shows a minimal embodiment 20 of an anchor point according to the invention, that includes only the swivel house 16 and ring 14, with the base plate-facing surface 16*a* of the swivel house abutting the surface 6 of the structural member. Without suitable adaptation, tightening the fastener will clamp the swivel house to the surface 6, and thereby hinder or completely prevent rotation of the swivel house. However, the head "H" of the fastener may be spaced above the surface 6, such as by use of a tubular washer or stand-off (not shown), to avoid this problem. Preferably, a washer 21 would be used between the head H and the cap-facing surface 16*b* of the swivel house to mediate the otherwise inevitable contact between the fastener head H and the swivel house.

Figure 7:
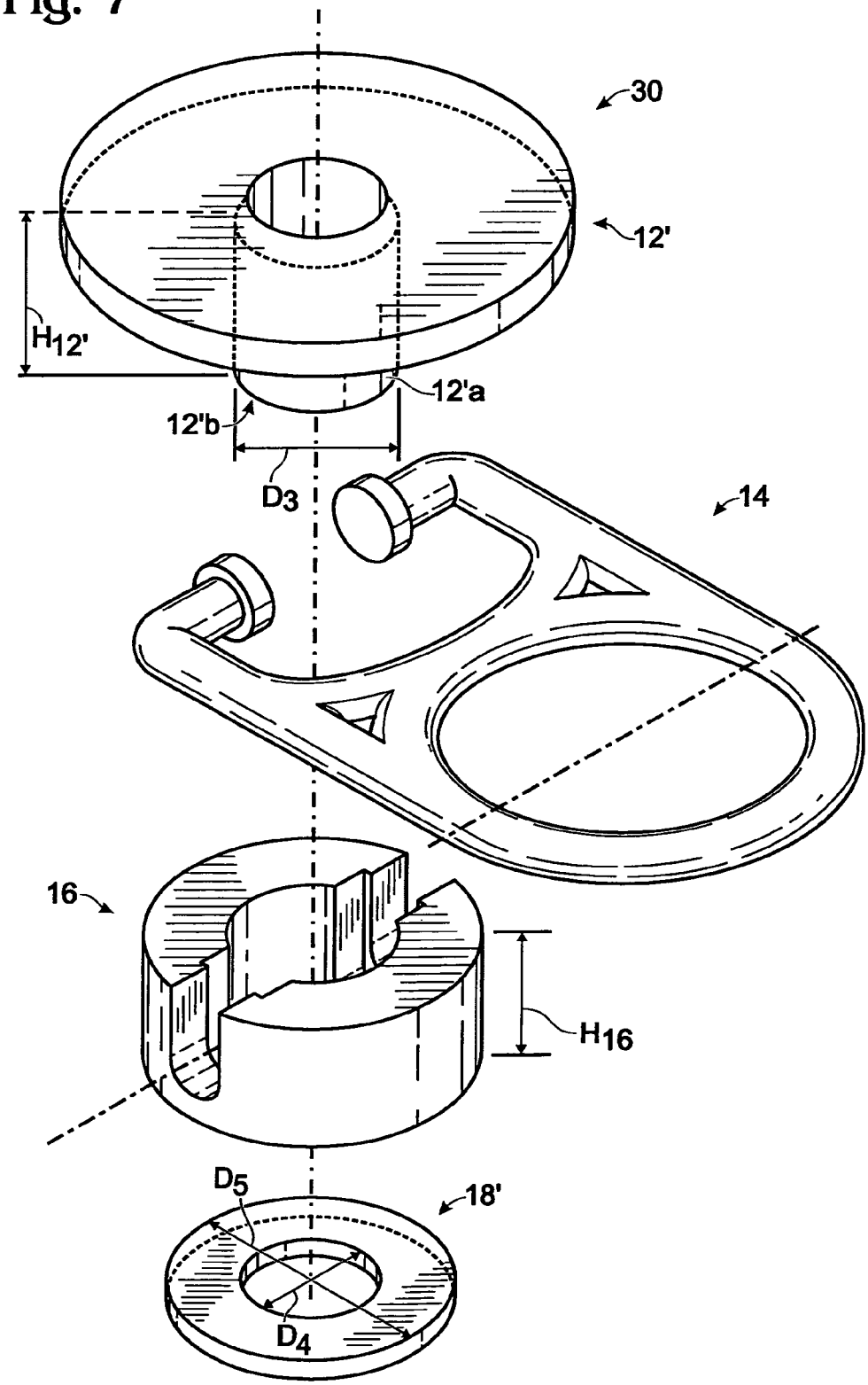
FIG. 7 is an isometric view of a second alternative embodiment of a swivel anchor point according to the invention.

FIG. 7 shows another alternative anchor point 30 according to the invention, having a base plate 12' and cap 18' that are modified versions, respectively, of the base plate 12 and cap 18. The base plate 12' includes a stand-off portion 12'*a* having a distal end 12'*b*.

The cap 18' is, essentially, a washer having an internal diameter $D_4$ and an external diameter $D_5$. The annulus thus defined seats on a distal end 12'*b* of the stand-off portion 12'*a* of the base plate 12', so that the swivel house is captured between the base plate 12' and the cap 18' as in the embodiment 10. The stand-off portion 12'*a* of the base plate 12'*a* projects above the floor of the baseplate by an amount $H_{12}'$ that is greater than the height $H_{16}$ of the swivel house 16, so that the swivel house can freely swivel about the stand-off portion 12'*a*.

As described, the embodiment 30 does not provide for centering the cap 18' relative to the stand-off portion 12'*a* of the base plate 12'. By contrast, the embodiment 10 does provide for centering the cap 18 relative to the base plate 12, by virtue of the portion 18*a* of the cap fitting into the hole 12*b* of the base plate. This functionality is not essential; however, it will be readily appreciated that it is desirable and can easily be provided in the embodiment 30 in like manner.

Anchor points according to the invention preferably provide at least over 90 degrees of pivot angle θ; more preferably at least over 150 degrees of pivot angle; and still more preferably at least over 175 degrees of pivot angle, with at least 180 degrees of pivot angle being optimum. As an independent consideration, anchor points according to the invention preferably provide at least up to 180 degrees of swivel angle ϕ; more preferably at least 350 degrees of pivot angle; and still more preferably at least 360 degrees of pivot angle, with over 360 degrees being optimum.

It should be noted that the preferred anchor point utilizes, as described and shown, circular and cylindrical surfaces and holes, to best facilitate relative rotation of the various parts as described. However, it should be understood that this is not a requirement. For example, the foot portions 14*b*F of the ring will still be able to turn within the stepped apertures 16*d* of the swivel house even if the foot portions are not cylindrical, and even if they are not smooth or continuously curved, e.g., they could be hexagonal.

Moreover, the preferred anchor point uses planar abutting and mutually facing surfaces as described and shown; however, where abutting surfaces provide for frictional engagement as described, and may be replaced by non-planar surfaces providing for either frictional or specific mechanical engagement due to have complementary mating features (such as pins and holes). Also, mutually facing surfaces that are spaced apart from one another need not be planar either.

Anchor points, including anchor points according to the present invention, must be capable, when mounted to a structure, of withstanding a 5,000 pound force applied to the ring in any direction, without breaking.

It is to be understood that, while a specific swivel anchor point has been shown and described as preferred, other configurations could be utilized, in addition to those already mentioned, without departing from the principles of the invention.

The terms and expressions which have been employed in the foregoing specification are used therein as terms of description and not of limitation, and there is no intention in the use of such terms and expressions to exclude equivalents of the features shown and described or portions thereof, it being recognized that the scope of the invention is defined and limited only by the claims which follow.

The invention claimed is:

1. A swivel anchor point, comprising:

a ring element defining a closed attachment aperture;

a capping element;

a housing element for mounting said ring element to a first mounting surface, said housing element defining a swivel axis, wherein said ring element includes two spaced apart leg members, said leg members including foot portions extending inwardly, toward said swivel axis, said foot portions having respective, spaced apart relatively enlarged ends, wherein said housing element includes foot apertures corresponding to said foot portions, said foot apertures being suitably sized, closer to said swivel axis, for pivotally receiving said ends, while being of a sufficiently smaller size, farther from said swivel axis, to prevent passage of said ends therethrough, said foot apertures thereby being adapted to capture said ends so that said ring element can be substantially freely rotated through a pivot angle of at least 90 degrees about a pivot axis that is perpendicular to said swivel axis, said housing element having an elongate capping aperture extending therethrough, said capping element being adapted to extend through said capping aperture and having a capping portion for capping said housing member at one end thereof while an end of said capping element protrudes beyond said housing element at the opposite end of said housing element and is available to abut the first mounting surface so as to space said capping portion and the first mounting surface apart by an amount sufficient to allow said housing element to substantially freely rotate about said capping element through a swivel angle of at least 180 degrees about said swivel axis; and a baseplate incorporating the first mounting surface, said baseplate for fastening to a second mounting surface independent of the first mounting surface, said baseplate and the protruding end of said capping element being adapted to interlock along an interlocking interface so as to resist displacement of the end of said capping element relative to said baseplate in directions perpendicular to said swivel axis, wherein, with reference to said capping portion being disposed, in terms of elevation, above said pivot axis, said interlocking interface is disposed below said pivot axis, said interlocking interface comprising said baseplate having a through hole and a recess, said protruding end comprising a stepped portion and a protruding portion extending therefrom with said protruding portion being received in said through hole and said stepped portion abutting said recess.

2. The anchor point of claim 1, wherein said capping element includes a fastener aperture extending through said capping element coaxially with said capping aperture, and further comprising a fastener for extending through said fastening aperture, past the end of said protruding portion, for engaging the second mounting surface, said fastener having an enlarged end that is larger than said fastening aperture, for capping said capping element.

3. The swivel anchor point of claim 1 wherein said baseplate extends laterally farther than does said housing.

4. The swivel anchor point of claim 3, wherein said baseplate extends laterally farther than do said leg members.

5. The anchor point of claim 3, wherein said capping element includes a fastener aperture extending through said capping element coaxially with said capping aperture, and further comprising a fastener for extending through said fastening aperture, past the end of said protruding portion, for engaging the second mounting surface, said fastener having an enlarged end that is larger than said fastening aperture, for capping said capping element.

6. The anchor point of claim 3, wherein said interlocking interface is disposed no higher in elevation than said foot portions.

7. The anchor point of claim 4, wherein said capping element includes a fastener aperture extending through said capping element coaxially with said capping aperture, and further comprising a fastener for extending through said fastening aperture, past the end of said protruding portion, for engaging the second mounting surface, said fastener having an enlarged end that is larger than said fastening aperture, for capping said capping element.

8. The anchor point of claim 7, wherein said interlocking interface is disposed no higher in elevation than said foot portions.

9. The anchor point of claim 5, wherein said interlocking interface is disposed no higher in elevation than said foot portions.

10. The anchor point of claim 4, wherein said interlocking interface is disposed no higher in elevation than said foot portions.

11. The anchor point of claim 2, wherein said interlocking interface is disposed no higher in elevation than said foot portions.

12. The anchor point of claim 1, wherein said interlocking interface is disposed no higher in elevation than said foot portions.

* * * * *